United States Patent [19]

Smith

[11] 4,074,552

[45] Feb. 21, 1978

[54] BURGLAR RESISTANCE LOCK ADAPTER KIT

[76] Inventor: Frank C. Smith, 28-14 Bronx Park East, Apt. 41, Bronx, N.Y. 10467

[21] Appl. No.: 759,736

[22] Filed: Jan. 17, 1977

[51] Int. Cl.[2] ..... E05B 15/16

[52] U.S. Cl. ..... 70/417

[58] Field of Search ..... 70/416, 417; 292/346

[56] References Cited

U.S. PATENT DOCUMENTS

| | | | |
|---|---|---|---|
| 3,083,563 | 4/1963 | Greenwald | 70/417 |
| 3,645,045 | 2/1972 | Gervis | 49/504 |
| 3,795,123 | 3/1974 | Stiffel | 70/417 |
| 3,844,144 | 10/1974 | Schmitt | 70/86 |
| 3,976,318 | 8/1976 | Krus | 292/346 |

*Primary Examiner*—Robert L. Wolfe

*Attorney, Agent, or Firm*—Richard L. Miller

[57] ABSTRACT

A kit mountable on a front side of a door and against a lock mounted in the door, the kit thus enclosing a front side of the lock from direct contact therewith by a burglar; the kit including a metal frame and a forwardly bulging metal plate secured by bolts to the door front side and which enclose a rotatable key bushing position in front of the lock tumbler which is thus accessible only by a specially long key for being turned.

3 Claims, 3 Drawing Figures

BURGLAR RESISTANCE LOCK ADAPTER KIT

This invention relates generally to burglar proof door locks.

A principal object of the present invention is to provide a burglar resistance lock adapter kit which can be readily and easily mounted in front of any door lock so to shield the lock front side against direct contact by a burglar tamper therewith.

Another object is to provide a burglar resistance lock adapter kit that necessitates use of a key that is longer than conventional lock keys so to further resist tamper by a burglar.

Still another object is to provide a burglar resistance lock adapter kit that will fit over locks having tumblers that may or may not project varying distances forwardly from the lock.

A further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

Figure 1:
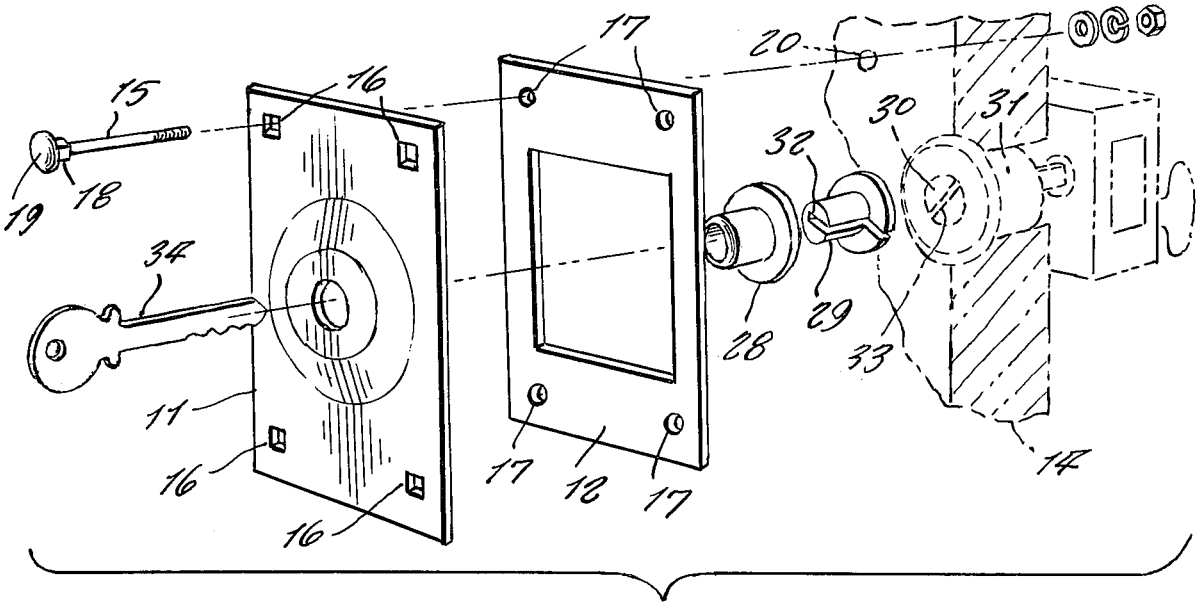
FIG. 1 is an exploded perspective view of the components of the present invention in relation to a door lock.
Figure 2:
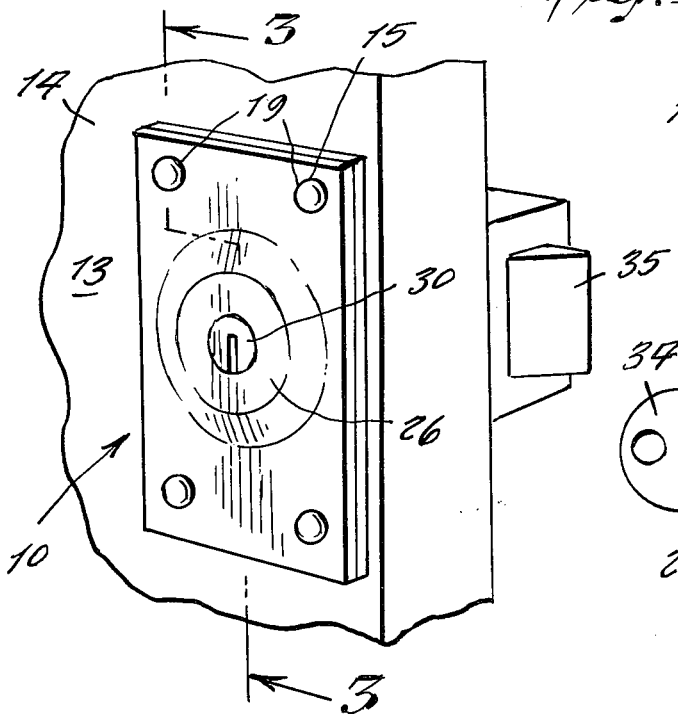
FIG. 2 is a perspective view thereof shown assembled on the door lock.
Figure 3:
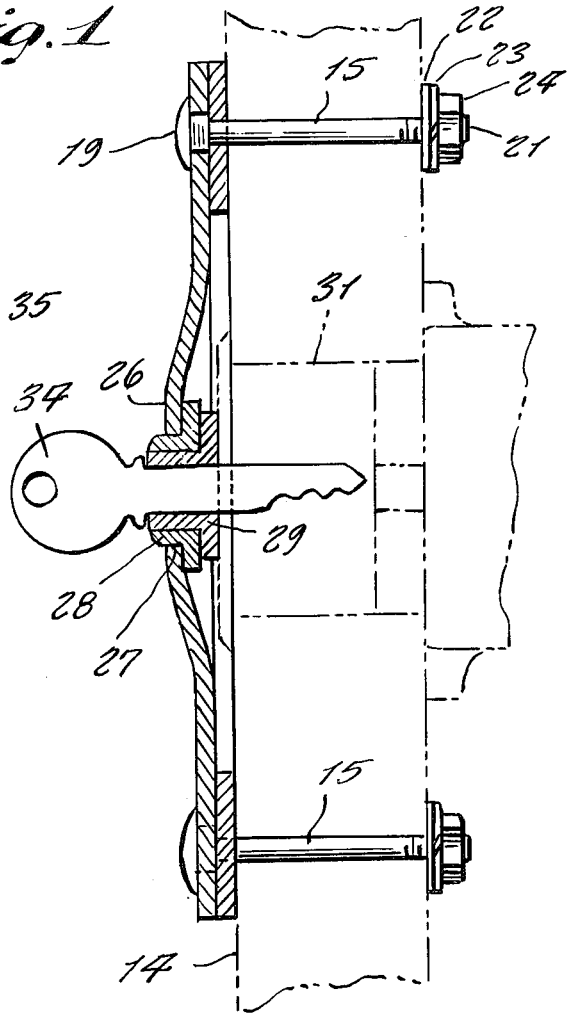
FIG. 3 is a cross-sectional view taken on line 3—3 of FIG. 2.

Referring now to the drawing in detail, the reference numeral 10 represents a burglar resistance lock adapter kit according to the present invention wherein the same includes a steel plate 11 and a same sized steel frame 12 which are mountable against a front side 13 of a door 14 by means of carriage bolts 15.

The plate has a square opening 16 near each corner that aligns with circular opening 17 in the frame. The carriage bolts each have a square shank portion 18 adjacent a slightly rounded head 19; the bolts being passed through holes 20 drilled through the door and protruding threaded ends 21 of the bolts then being such fitted with a washer 22, lockwasher 23 and a nut 24. The head 19 provides no means for being grasped and turned by a burglar.

The plate 11 has a forewardly bulge 26 at its center and a central opening 27 therethrough in which is fitted with a sleeve 28 and a freely rotatable key bushing 29 which is positioned directly in front of a tumbler 30 of a lock 31 mounted conventionally in the door 14. The key bushing 29 includes a flange that abuts against a rear of the flanged sleeve 28. The rear of the bushing abuts against a front end of the tumbler 30. If the tumbler protrudes from the lock, more or less spacers, not shown, may be inserted between the sleeve and bushing so to fill any excessive space between the plate 11 and the front face of the tumbler. each A slot 32 is provided on the key bushing for aligning with the key slot 33 of the tumbler.

A key 34 accordingly is made extra long so to extend through the bushing as well as entering the lock tumbler the usual distance so to slide the tumbler pins and unlock the tumbler in order that it may be rotated so to operate mechanical linkage that slides lock bolt 35 from a latch plate mounted on the door jamb.

Thus the kit shields the lock from direct contact by a burglar.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A burglar resistance lock adapter kit comprising, in combination, a thin steel plate and a thin steel frame of approximately the same size mounted on a front side of a door by means of carriage bolts and enclosing a rotatable key bushing positioned in front of a tumbler of a lock of said door, an extra long key for insertion through said key bushing and into said lock for unlocking said lock, a sleeve fitted around said key bushing with said key bushing being rotatable within said sleeve, said thin steel plate having a bulging section and a central opening in said bulging section, said sleeve and key bushing extending through said central opening, and flange means on said key bushing and sleeve to retain them behind said bulging section of said thin steel plate.

2. The combination as set forth in claim 1 wherein said key bushing includes a slot that can be aligned with a key slot of said lock tumbler, for receiving said key therethrough.

3. The combination as set forth in claim 1 wherein each said bolt includes a square shank portion adjacent a rounded low head thereof and which aligns with a square opening through said plate, each said bolt extending also through said frame and door and being fitted with a washer, lockwasher and nut on an inner side of said door.

* * * * *